US007163736B2

(12) United States Patent
Takahashi

(10) Patent No.: US 7,163,736 B2
(45) Date of Patent: Jan. 16, 2007

(54) RUBBER REINFORCING FIBER CORD, METHOD OF MANUFACTURING THE SAME, AND RADIAL PNEUMATIC TIRE FOR PASSENGER CAR USING THE SAME

(75) Inventor: Shuji Takahashi, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 11/387,692

(22) Filed: Mar. 24, 2006

(65) Prior Publication Data

US 2006/0188716 A1 Aug. 24, 2006

Related U.S. Application Data

(63) Continuation of application No. PCT/EP03/04197, filed on Apr. 17, 2003.

(30) Foreign Application Priority Data

Mar. 31, 2005 (JP) ..... 2005-100816

(51) Int. Cl.
*B32B 17/12* (2006.01)
*B32B 25/02* (2006.01)
*B60C 9/00* (2006.01)

(52) U.S. Cl. ..... 428/294.1; 428/295.1; 152/451

(58) Field of Classification Search ..... 428/294.1, 428/295.1; 152/451; 435/395; 427/389
See application file for complete search history.

(56) References Cited

U.S. PATENT DOCUMENTS 5,041,497 A * 8/1991 Bhattacharjee et al. .. 525/54.11
6,376,636 B1 * 4/2002 Hansma et al. ..... 528/32

FOREIGN PATENT DOCUMENTS

JP 11-301208 A 11/1999

OTHER PUBLICATIONS

"Pneumatic Tires—Automobile, Truck, Airplane, Motorcycle, Bicycle" by Henry C. Pearson *Encyclopedia of Tires Manufacture, History, Processes, Machinery, Modern Repair and Rebuilding, Patents, Etc., Etc.*, 1922 pp. 170-173.

* cited by examiner

*Primary Examiner*—N. Edwards
(74) *Attorney, Agent, or Firm*—Connolly, Bove, Lodge & Hutz, LLP

(57) ABSTRACT

Disclosed is a rubber reinforcing fiber cord in which an eco-friendly silk material is made usable for applications in an automobile pneumatic tire and the like acted upon by large loads. The rubber reinforcing fiber cord of the present invention is characterized in that: a multi-filament twisted cord formed of silk fibroin fibers having a total fineness of 1500 to 9000 dtex is covered with an adhesive agent formed of resorcin, formalin and rubber latex in order that a dip pickup thereof on the cord can become 4.0 to 8.0% per unit weight of the fibers; and the cord has an initial tensile strength not less than 3.5 cN/dtex, a high-temperature strength retention rate not less than 80%, and a post-moisture-absorption strength retention rate not less than 85%. The cord is usable in a belt reinforcing later and/or a carcass layer of a radial pneumatic tire for a passenger car.

11 Claims, 1 Drawing Sheet

RUBBER REINFORCING FIBER CORD, METHOD OF MANUFACTURING THE SAME, AND RADIAL PNEUMATIC TIRE FOR PASSENGER CAR USING THE SAME

This application is a Continuation of PCT/EP03/04197 filed Apr. 17, 2003 which in turn claims priority from Italian Application MI2002A000865, filed April 22, 2002.

This application claims priority from Japanese Application 2005-100816, filed Mar. 31, 2005.

BACKGROUND OF THE INVENTION

The present invention relates to a rubber reinforcing fiber cord, a method of manufacturing the same, and a radial pneumatic tire for a passenger car using the same. More specifically, the present invention relates to a rubber reinforcing fiber cord in which silk fibroin fibers are made usable for reinforcement of an automobile pneumatic tire and the like, a method of manufacturing the same, and a radial tire for a passenger car using the same.

For reinforcing fiber cords of rubber products including a pneumatic tire, synthetic fibers of nylon, polyester or the like based on petroleum resources are generally used. However, upon disposal of synthetic fibers, even if buried in the ground, they are never decomposed, and remain as environmental pollutants. Additionally, if incinerated, the synthetic fibers generate hazardous gas, and therefore become sources of environmental pollution as well. Therefore, as an environmental protection measure, it has been desired that materials made from non petroleum resources be used for the rubber reinforcing fiber cords.

Conventionally, in rubber reinforcing fiber cords, rayon fibers made from wood have been long known as materials made of non petroleum resources. Even today, rayon fibers are used for carcass layers of a part of pneumatic tires of passenger cars. However, since rayon fibers require use of toxic substances such as carbon disulfide in a manufacturing process therefor, it is necessary that this carbon disulfide should be strictly controlled in the manufacturing process in order to prevent the carbon disulfide from bringing about environmental pollution. Additionally, because forests should be logged for raw material procurement of rayon fibers, there is a problem that the raw material procurement thereof leads to destruction of the global environment. Accordingly, with respect to materials used for carcass layers especially for radial pneumatic tires of passenger cars, replacement of rayon fibers by polyester fibers has been in progress.

In contrast to rayon fibers as described above, silk is a biological resource, and if buried in the ground, is eaten by bacteria and disappears. Therefore, silk attracts attention as a material which does not involve a problem of environmental destruction. However, examples in the past which utilized silk strings for rubber reinforcing fiber cords can be found only with respect to bicycle tires, for instance, in descriptions in "Pneumatic Tire" (Henry C. Pearson, 1992, page 172) and in the paragraph 0025 of Japanese patent application Kokai publication No. Hei 11-301208. Nevertheless, there cannot be found an example utilizing silk strings in an automobile tire which bears a considerably large load as compared to a bicycle tire.

As one of the reasons why there is no example utilizing silk for a reinforcing fiber cord of an automobile tire used under such a severe condition, it can be considered that adhesion of silk strings to rubber has been insufficient. For example, there has been disclosed utilization of a natural-rubber based adhesive agent, a chloroprene based adhesive agent or the like as a method of adhering silk fibers to rubber in Patent Document 1. However, these adhesive agents not only cannot secure adhesion to rubber sufficient for a reinforcing fiber cord of an automobile tire used under the severe condition, but also are not favorable to the environment because organic solvents are used therein. Additionally, since silk fibroins are made of protein because of a characteristic intrinsic to silk, there can be cited another problem that silk fibroins have inferior thermal stability and low thermal resistance. Moreover, a surface of silk is covered with sericin which is a water-soluble protein, and it is difficult to completely remove this sericin through a refinement utilized industrially. The remaining sericin is assumed to be a factor of adhesion deterioration. Furthermore, there can be cited still another problem that the remaining water-soluble sericin facilitates acceleration of moisture absorption, and is likely to incur strength deterioration due to moisture absorption. These problems are assumed to be the reasons why silk has not been utilized for reinforcing fiber cords in rubber products, such as an automobile tire, which are acted upon by large loads and involve heat generation.

SUMMARY OF THE INVENTION

A first object of the present invention is to provide a rubber reinforcing fiber cord in which eco-friendly silk strings are made usable for applications in an automobile pneumatic tire and the like acted upon by large loads, and a method of manufacturing the same.

A second object of the present invention is to provide a radial pneumatic tire for a passenger car using the abovementioned rubber reinforcing fiber cord, and thereby realizing excellent high-speed durability and road noise reduction effect. A third object of the present invention is to provide a radial pneumatic tire for a passenger car using the abovementioned rubber reinforcing fiber cord, and thereby realizing excellent driving stability and enhanced riding comfort.

The rubber reinforcing fiber cord of the present invention achieving the first object is characterized in that: a multi-filament twisted cord formed of silk fibroin fibers having a total fineness of 1500 to 9000 dtex is covered with an adhesive agent formed of a mixture of resorcin, formalin and rubber latex; a coverage of the adhesive agent covering the cord is not less than 4.0% and not more than 8.0% per unit weight of the fiber; and the covered twisted cord has an initial tensile strength not less than 3.5 cN/dtex, a high-temperature strength retention rate not less than 80%, and a post-moisture-absorption strength retention rate not less than 85%.

The method of manufacturing the above rubber reinforcing fiber cord is characterized by including the steps of: covering a multi-filament twisted cord formed of silk fibroin fibers having a total fineness of 1500 to 9000 dtex with an adhesive agent, which is formed of a liquid mixture of resorcin, formalin and rubber latex, by applying the adhesive agent in order that a solids content in a coverage of the adhesive agent covering the cord can become not less than 4.0% and not more than 8.0% per unit weight of the fibers; and thermally treating the twisted cord at a temperature between 140 and 200° C. inclusive after drying the twisted cord at a temperature between 90 and 130° C. inclusive.

Additionally, a radial pneumatic tire for a passenger car according to the present invention achieving the second object is a radial pneumatic tire in which: a carcass layer is arranged between left and right bead portions; belt layers are arranged to an outer periphery of the carcass layer; and a belt reinforcing layer formed by winding a reinforcing cord around in a circumferential direction of the tire is arranged in at least one region out of regions to an outer periphery of the belt layers, to an inner periphery thereof, and between the outer and inner belt layers. The radial pneumatic tire is characterized in that a rubber reinforcing fiber cord according to any one of claims 1 to 7 is used as the reinforcing cord of the belt reinforcing layer.

Additionally, the radial pneumatic tire for a passenger car according to the present invention achieving the third object is a radial pneumatic tire in which a carcass layer is arranged between left and right bead portions, and characterized in that the rubber reinforcing fiber cord formed of the above configuration is used as the reinforcing cord of the carcass layer.

The rubber reinforcing fiber cord of the present invention is eco-friendly since the silk fibroin fibers are used as a raw material thereof. In addition, by covering the multi-filament twisted cord with the adhesive agent formed of resorcin, formalin and rubber latex in order that a solids content in the adhesive agent coverage can become not less than 4.0% and not more than 8.0% per unit weight of the fibers, adhesion thereof to rubber is enhanced. At the same time, sericin in a surface layer of the silk string can be efficiently cross-linked by means of formalin in the adhesive agent of resorcin, formalin and rubber latex, and thermal stability of the silk fibroin fibers can be enhanced. Accordingly, the cord can attain an initial tensile strength not less than 3.5 cN/dtex, a high-temperature strength retention rate not less than 80%, and a post-moisture-absorption strength retention rate not less than 85% while having the total fineness of 1500 to 9000 dtex. Thereby, the cord can be effectively used as a reinforcing material for applications in rubber products, such as an automobile tire, which are acted upon by large loads and involve heat generation.

Additionally, according to the method of manufacturing a rubber reinforcing fiber cord of the present invention, a rubber reinforcing fiber cord having the above properties can be obtained by applying the liquid mixture of resorcin, formalin and rubber latex to the multi-filament twisted cord in order that a coverage of the adhesive agent covering the cord can become a predetermined amount, then drying the cord at a temperature between 90 and 130° C. inclusive, and thereafter thermally treating that cord at a temperature between 140 and 200° C. inclusive.

By using for a belt reinforcement layer the rubber reinforcing fiber cord having the above properties, the radial pneumatic tire for a passenger car according to the present invention is enabled to secure high-speed durability as excellent as is secured by using a conventional nylon fiber cord, and simultaneously is enabled to obtain a further excellent road noise reduction effect.

By using for a carcass layer the rubber reinforcing fiber cord having the above properties, an other radial pneumatic tire for a passenger car according to the present invention is enabled to obtain driving stability and riding comfort as favorable as are obtained by using a conventional polyester fiber cord.

DESCRIPTION OF THE PREFERRED EMBODIMENTS

Figure 1:
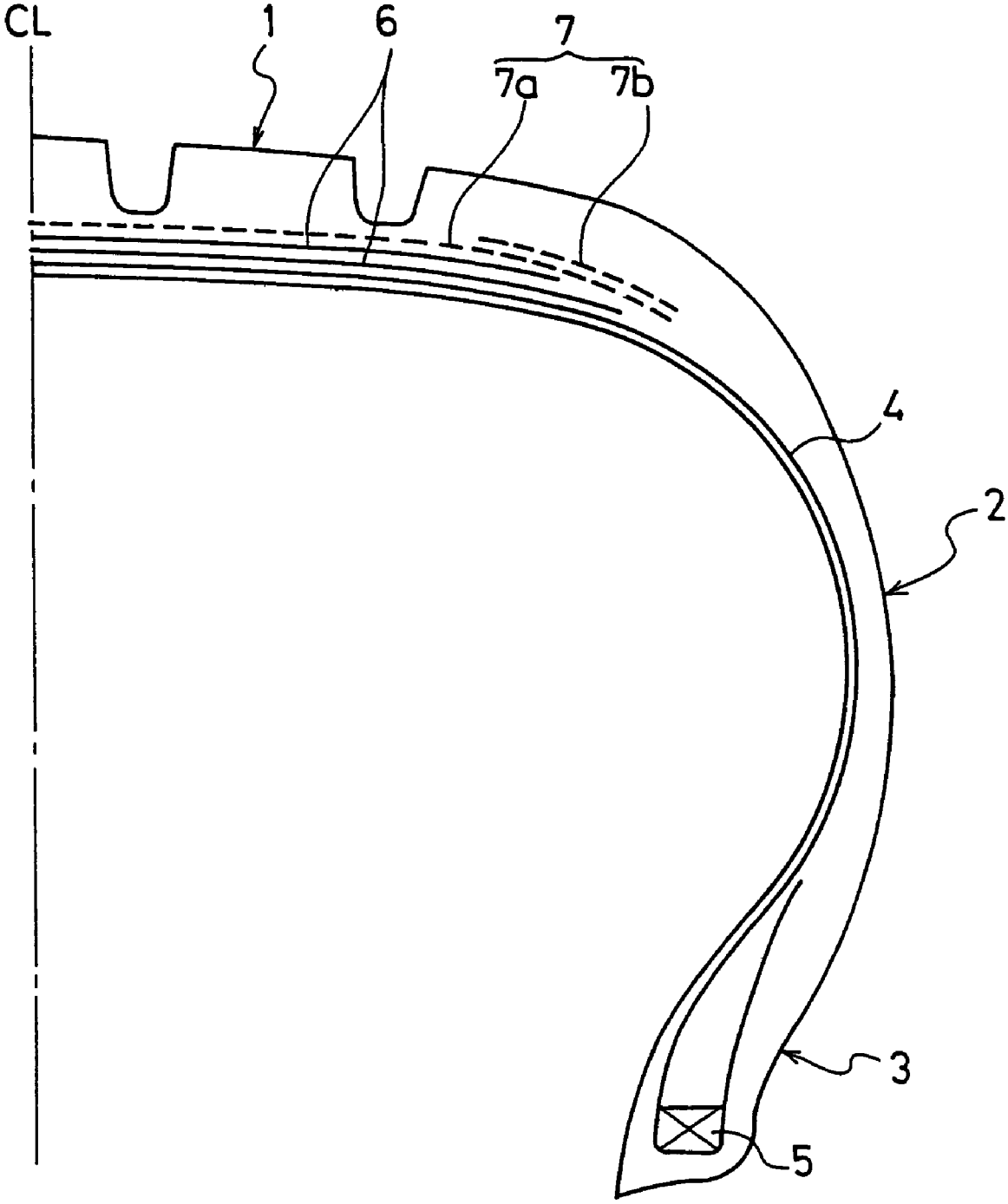
FIG. 1 is a half cross-sectional view illustrating an example of a radial pneumatic tire for a passenger car using a rubber reinforcing fiber cord of the present invention.

In the present invention, a silk fibroin fiber means a polypeptide fiber having a chemical structure in which a large number of amino-acid components in various kinds are combined in a chain, and preferably, means the polypeptide fiber containing alanine and glycine whose total content in amino-acid components thereof is not less than 60%. As examples of silk fibroin fibers satisfying this requirement, in addition to a silk string obtained from domesticated or wild silkworms, there can be cited: a silk-like string obtained from arachnids (spiders); a silk-like string manufactured through a gene recombination technique based on genes from domesticated or wild silkworms, arachnids (spiders) or the like; and the like.

Among the silk fibroin fibers cited above as examples, as variations for the silk-like string obtained from arachnids (spiders), there are: a drag line discharged from a hip of a spider when the spider is airborne while hanging down in the air; each of radials set stretching so as to be radial when the spider is creating a trapping net with discharged strings; each of viscid threads set in polygonal shapes in multiple stages around the center of the radiation so as to extend between the strings set stretching so as to be radial; and the like. Among these silk-like string, because the drag line when the spider is hanging down in the air particularly has high strength and elasticity modulus, the drag line is an object preferable to be utilized. On the other hand, regarding the silk-like string manufactured through a gene recombination technique based on genes of domesticated or wild silkworms, arachnids (spiders), or the like, there has been a report that, by implanting into a goat a gene creating strings of a spider, silk fibroin protein was extracted from milk milked from the goat, and a silk-like string was obtained through wet spinning by using that protein.

Formula 1 in the below indicates one example of chemical structures of silk fibroin, which is composed of a large number of amino-acid components in various kinds combined in a chain. Formulas 2A to 2D indicate representative examples of amino-acid components, Formulas 2A, 2B, 2C and 2D indicate alanine, glycine, aspartic acid, and arginine, respectively. Other than those indicated by Formulas 2A to 2D, as amino-acid components which may constitute the silk fibroin, there can be cited isoleucine, glutamic acid, cysteine, serine, tyrosine, tryptophan, threonine, valine, histidine, phenylalanine, proline, methionine, lysine, leucine and the like.

(Formula 1)

Silk fibroin chemical structure

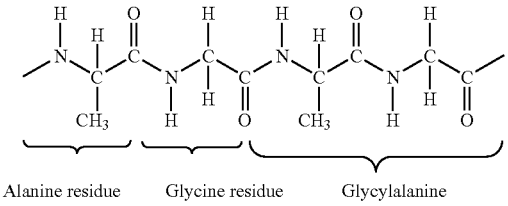

(Formula 2)

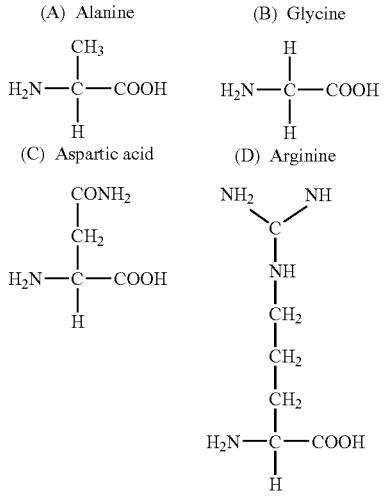

It is preferable that silk fibroin fibers used for a rubber reinforcing fiber cord of the present invention contain alanine and glycine whose total content in amino-acid components thereof be not less than 60%. By thus containing alanine and glycine with a high total content thereof, the silk fibroin fibers can be provided with high strength and elasticity modulus. It is further preferable that the silk fibroin fibers used for a rubber reinforcing fiber cord contain aspartic acid and arginine whose total content in amino-acid components thereof be low, and it is particularly preferable that they contain aspartic acid and arginine whose total content in amino-acid components thereof is not more than 5%.

The silk fibroin fibers containing aspartic acid and arginine whose total content in amino-acid components thereof is more than 5% tend to have lower elasticity moduli due to disorder in protein structures thereof. Therefore, when any of these silk fibroin fibers are used in a belt reinforcing layer of a radial pneumatic tire, high speed durability of the tire becomes relatively low, and additionally, a road noise reduction effect thereof also becomes relatively low. Moreover, when any of these silk fibroin fibers are used in a carcass layer of a radial pneumatic tire, a driving stability enhancement effect of the tire becomes relatively low.

Among representative examples of silk fibroin fibers containing aspartic acid and arginine whose total content in amino-acid components is not more than 5%, there is a silk string (in which, a total content of aspartic acid and arginine in amino-acid components is 2.6%) obtained from domesticated silkworms. In addition, a silk string (in which, a total content of aspartic acid and arginine is 0.9%) obtained from Anaphe silkworms of wild silkworms is also applicable as an example thereof. Silk strings obtained from Tensan (*Antheaea yamamai*), Sakusan (*Antheraea pernyi*), and Erisan (*Samia cynthia risini*) silkworms have total contents of aspartic acid and arginine of 12.7%, 13.9%, and 8.3%, respectively, and have lower elasticities than those obtained from domesticated silkworms (*Bombyx mori*) and the Anaphe silkworms.

In the present invention, a total content in amino-acid components means what is obtained by the following measuring method.

To a specimen of silk fibroin fibers, a 0.5% anhydrous sodium carbonate solution whose amount is 50 times of that of the specimen is added. Then, a refinement of the specimen is performed for 20 minutes by heating the solution to a temperature between 85 and 90° C. inclusive while agitating the solution. After the refinement, washing of the specimen by using distilled water is repeated to a sufficient degree. After removing a sericin component attached on a surface of the fiber, the specimen is weighed. When the silk fibroin has come to show no weight change after repeating the above operation, an amino acid composition analysis is performed on the silk fibroin which therefore can be assumed to have the sericin component completely removed. With respect to this silk fibroin, a hydrolytic degradation is performed by: adding thereto hydrochloric acid excessively having 6 times the normal concentration to a predetermined amount of the silk fibroin; hermetically sealing the silk fibroin after removing dissolved oxygen therefrom; and treating the silk fibroin at a temperature of 110° C. for 24 hours. After the hydrolytic degradation, the silk fibroin is evaporated to dryness by expelling a hydrochloric acid component therefrom above a warm bath. The hydrolysate thus obtained is dissolved in a citrate buffer solution, and then a quantitative analysis regarding amino acids is performed on the hydrolysate by means of an ion-exchange chromatograph. An amino-acid composition obtained by the quantitative analysis is represented in terms of weight percentage of an amino acid contained in 100 grams of the silk fibroin.

For the rubber reinforcing fiber cord of the present invention, silk fibroin fibers are used in a form of a multifilament twisted cord. For the silk fibroin fibers, ones having a total fineness in a range from 1500 to 9000 dtex inclusive, and preferably in a range from 1700 to 8000 dtex inclusive, are used. In addition, the ones having an initial tensile strength not less than 3.5 cN/dtex, and preferably not less than 3.8 cN/dtex, upon completion of an adhesive agent treatment are selected. Additionally, the ones having a tensile elasticity modulus preferably not less than 40 cN/dtex, and more preferably not less than 55 cN/dtex, upon completion of the adhesive agent treatment are used. Furthermore, the ones having a tensile elasticity modulus not less than 10% also upon completion of the adhesive agent treatment are preferably used.

Here, the initial tensile strength means a strength upon completion of the adhesive agent treatment, which is a strength under a condition that the cord has not undergone a history under a high humidity environment and/or a history under a high temperature environment. Additionally, a tensile strength and a tensile elasticity modulus may be referred to simply as "a strength" and "an elasticity modulus," respectively, in some cases.

If the rubber reinforcing fiber cord simultaneously has a total fineness less than 1500 dtex, and an initial tensile strength less than 3.5 cN/dtex, it makes the rubber reinforcing fiber cord to have a reinforcing effect insufficient as a reinforcing cord for a rubber product acted upon by a large load comparable to a load upon an automobile tire. Moreover, when the rubber reinforcing fiber cord as above is used as a reinforcing cord of a radial passenger automobile pneumatic tire, it becomes difficult to obtain satisfactory high speed durability and driving stability. On the other hand, if the rubber reinforcing fiber cord has a total fineness more than 9000 dtex, there is a problem that, when bending is applied to the cord, surface distortion thereof increases and makes a rubber product using the cord to tend to decrease in durability. Furthermore, there are also some other problems including a problem that, with increasing thickness of the cord, a surface area of the cord adhered to rubber decreases, whereby adhesion strength thereof is reduced. With these problems, the cord having a total fineness more than 9000 dtex is not preferable.

There is no particular upper limit set for the initial strength of the rubber reinforcing fiber cord because the higher the initial tensile strength is, the more preferable it is. However, with respect to a possible upper limit of the initial tensile strength by using silk fibroin fibers obtained from natural biological resources, it is about 5.0 cN/dtex as that of the original fibers. Similarly, there is no particular upper limit set for the elasticity modulus of the rubber reinforcing fiber cord because the higher the elasticity modulus, the more preferable. With respect to a possible upper limit of the elasticity modulus by using silk fibroin fibers obtained from natural biological resources, it is about 100 cN/dtex as that of the original fibers. However, when it comes to silk fibroin fibers manufactured by a gene recombination technique, researches in the future have a possibility of making available strength and elasticity which are larger than those naturally available.

A twisting structure of the twisted cord is not particularly limited, and the structure is preferably of two-direction twisting but may be of one-direction twisting. Additionally, the number of twists of the cord is not particularly limited, but the number of twists which allows a second twist coefficient K expressed by the following equation (1) to be in a range from 500 to 3500 inclusive is preferably used for the purpose of reinforcing rubber. For a belt reinforcing cord of a radial pneumatic tire for a passenger car, it is more preferable that the second twist coefficient K be in a range from 650 to 1500 inclusive. For a carcass reinforcing cord thereof, it is more preferable that the second twist coefficient K be in a range from 1500 to 3000 inclusive.

$$K=T\sqrt{D} \quad (1)$$

where T, and D denote the number of second twists (turns/10 cm), and a total fineness of the cord (dtex), respectively.

Furthermore, in the case of the two-direction twisting, as a ratio of the number of first twists to the number of second twists, a value in a range from 0.7 to 1.3 inclusive is generally used.

Surfaces of the rubber reinforcing fiber cord of the present invention are covered with an adhesive agent formed of a mixture of resorcin, formalin and rubber latex (hereinafter, referred to as "RFL") in order that a solids content of a dip pickup of the adhesive agent covering the cord can become not less than 4.0% and not more than 8.0% per unit weight of the fibers. By covering the cord with the dip pickup of the above described RFL adhesive agent, it becomes possible to secure high adhesion thereof to rubber, and at the same time, it becomes possible to suppress chronological reduction in strength thereof under a high humidity and under a high temperature, the chronological reduction in strength being considered as a weakness specific to silk fibroin fibers.

Kinds of resorcin, formalin and rubber latex constituting the RFL adhesive agent are not particularly limited, respectively. Nevertheless, if the dip pickup of the RFL adhesive agent is less than 4.0% per unit weight of the fibers, it not only makes it difficult to secure high adhesion of the cord to rubber, but also makes a barrier effect of the adhesive agent lower. As a result, it leads to a larger reduction of a strength retention rate of the cord under an environment where the cord suffers thermal oxidization. Furthermore, it leads to a larger reduction of the strength retention rate of the cord due to moisture absorption.

On the other hand, if the dip pickup of the RFL adhesive agent exceeds 8.0%, the excessive dip pickup causes moisture to remain in the adhesive agent because desiccation of the adhesive agent progresses from a surface thereof. Thereby, in a subsequent thermal treatment, foam is generated in the adhesive agent layer in a process of evaporating residual moisture and makes the adhesive agent layer vulnerable. As a result, there arises a problem that adhesion failures occur in a layer of the adhesive agent, and cause reduction of the adhesion. Additionally, because an amount of foam becomes larger in the adhesive agent layer, diffusion of oxygen and moisture therein is facilitated all the more. This leads to reduction in the barrier effect of the RFL adhesive agent, thereby bringing about a reduction in high-temperature strength of the cord, and a reduction in strength thereof from moisture absorption. Moreover, the excessive dip pickup of the RFL adhesive agent makes the cord hard, and therefore reduces the strength thereof, thereby hindering fibers, particularly fibers as silk which are not very high in strength in an unprocessed state, from sufficiently exerting rubber reinforcing functions.

In the present invention, a more preferable dip pickup of the RFL adhesive agent on the fiber cord is in a range from 4.5% to 7.5% inclusive per unit weight of the fibers thereof.

With regard to a method of controlling the dip pickup of the RFL adhesive agent applied onto a surface of the fibers, it is possible to control it by means of: a concentration of the adhesive agent; a drawing pressure or a vacuum pressure after the cord is soaked in the adhesive agent; or the like. However, more preferably, it is the easiest to control it by means of the concentration of the adhesive agent.

As the RFL adhesive agent used in the present invention, it is preferable to use the one having a molar ratio of formalin to resorcin (hereinafter, referred to as "F/R molar ratio") in a range from 2.0 to 3.5 inclusive.

If the F/R molar ratio of the RFL adhesive agent is less than 2.0, cross-linkage of sericin in a surface layer of the silk fibroin fibers by means of formalin becomes insufficient, whereby it becomes difficult to suppress moisture absorption of the sericin. As a result, an effect of suppressing a strength reduction due to moisture absorption is reduced in the cord. Additionally, not only an initial adhesion strength thereof to rubber but also a water resistant adhesion strength thereof are reduced, whereby it becomes difficult for the cord to satisfy functions of rubber products particularly in the products such as a pneumatic tire for a passenger car which demand high durability. On the other hand, if the F/R molar ratio exceeds 3.5, the cord becomes too hard, whereby not only an initial strength thereof but also high temperature strength retention rate and adhesion strength are reduced.

As the RFL adhesive agent used in the present invention, it is preferable to use the one having a ratio of a solids content of resorcin and formalin to a solids content of rubber latex (hereinafter, referred to simply as "RF/L solids content weight ratio" for short) set in a range from 0.20 to 0.35 inclusive.

If the RF/L solids content ratio of the RFL adhesive agent is less than 0.20, a resin content of resorcin and formalin in the RFL adhesive agent layer covering the surface layer of the silk fibroin fibers becomes smaller, whereby a high temperature strength retention rate of the silk fibroin fibers becomes likely to decrease. Additionally, because an amount of a resin portion cross-linked through a thermal treatment becomes smaller, a reduction in water resistant adhesion strength thereof is brought about, whereby, particularly in products such as a pneumatic tire for a passenger car which demand high durability, it becomes difficult for the cord to satisfy functions thereof.

On the other hand, if the F/R molar ratio of the RFL adhesive agent exceeds 3.5, the cord becomes too hard, whereby not only the initial strength thereof is reduced, but also a rubber content in the adhesive agent becomes smaller. The rubber content having become smaller leads to reduction of a crosslinking property of the adhesive agent with rubber where the fiber cord is to be buried, whereby the adhesion strength of the cord is reduced.

As examples of the rubber latex used in the RFL adhesive agent, there can be cited vinylpyridine-styrene-butadiene terpolymer rubber latex, styrene-butadiene copolymer rubber latex, natural rubber latex, NBR rubber latex, chloroprene latex and the like. Which among these is used may be selected as appropriate based on rubber which is attached by using the adhesive agent.

For the total fineness of the silk fibroin fibers used in the present invention, a value calculated in the following manner is expressed in "dtex" and used as a total fineness. A portion of exactly 10 meters is sampled from the fiber cord, is dried at a temperature of 105° C. for at least 2 hours, and is cooled to a room temperature inside a desiccator. Immediately after the cooling, a weight of the fibers is measured. A value then calculated as a weight equivalent to 1000 meters of the cord is used as the total fineness. That is, the total fineness is indicated in terms of absolute dry fineness.

The dip pickup of the RFL adhesive agent to the fiber cord is a value calculated in the following manner. An absolute dry weight (W0) of unprocessed fibers of a certain length is previously measured, and subsequently, after the fibers are soaked in the adhesive agent and are dried to be thermally treated, a portion of the cord for which the absolute dry weight has been previously measured is sampled to measure an absolute dry weight (W1) thereof. Thereafter, based on this absolute dry weight (W1) and the absolute dry weight (W0) of the foregoing unprocessed fibers, the value is calculated by using Equation (2) in the below:

$$\text{Dip Pickup}=(W1-W0)/W0\times 100(\%) \quad (2)$$

Additionally, the initial strength means a tensile strength (So) measured in the following manner. Under an atmosphere at a temperature of 20° C., the cord already treated with the RFL adhesive agent is dried for 24 hours in a vacuum inside a desiccator containing a desiccant, and thereby comes into a state substantially having no moisture absorbed therein. Immediately after the drying, the tensile strength (So) of the cord is measured.

The high-temperature strength retention rate is a value obtained in the following manner. After the cord processed with the RFL adhesive agent is thermally treated at a temperature of 180° C. for 5 hours inside an air oven, that cord is cooled to a temperature of 20° C. inside a desiccator containing a desiccant. Immediately after the cooling, a tensile strength (Sa) of the cord is measured. Based on this tensile strength (Sa) and the initial tensile strength (So), the value is obtained from Equation (3) in the below:

$$\text{High-temperature strength retention rate (\%)}=(Sa/So)\times 100 \quad (3)$$

Additionally, the post-moisture-absorption tensile strength retention rate is a value obtained in the following manner. After the above processed cord dried in a vacuum is left under an atmosphere at a temperature of 20° C. and at a humidity of 60% for 24 hours, a tensile strength (Sb) of the cord is measured. Based on this tensile strength (Sb) and the initial tensile strength (So), the value is obtained from Equation (4) in the below:

$$\text{Post-moisture-absorption strength retention rate (\%)}=(Sb/So)\times 100 \quad (4)$$

The elasticity modulus is calculated, based on a stress-distortion curve obtained from measurement of the tensile strength, from a slope between the two points corresponding to distortions under a load of 0.5 cN/dtex, and under a load of 1.0 cN/dtex in the stress-distortion curve.

In the RFL adhesive agent used in the present invention, it is more preferable to compound an isocyanate derivative. By compounding the isocyanate derivative therein, a water resistant adhesion strength of the rubber reinforcing fiber cord can be more enhanced. It is preferable that a compounding amount of the isocyanate derivative be from 5 to 50 weight parts inclusive in 100 weight parts of a solids content of resorcin, formalin and rubber latex in the adhesive agent.

If the compounding amount of the isocyanate derivative is less than 5 weight parts, an effect of enhancing a water resistant adhesion strength can hardly be obtained. If the compounding amount is set more than 50 weight parts, the effect of enhancing the water resistant adhesion strength is almost saturated, and an excess of the isocyanate derivative is wasted. Additionally, the excess of the isocyanate derivative reduces the initial strength of the cord. More preferably, the compounding amount is in a range from 10 to 30 weight parts inclusive.

As examples of the isocyanate derivative thus used, there can be cited: blocked isocyanate obtained by blocking methyl diisocyanate (MDI) or tolylene diisocyanate (TDI) with phenol, ε-caprolactam, keto oxime, or the like; thermoreactive polyurethane; and the like.

It is preferable that the above described rubber reinforcing fiber cord of the present invention be manufactured in a method as described below.

First, as the silk fibroin fibers, multi-filament strings having a total fineness of 1500 to 9000 dtex is prepared. Preferably, the multi-filament strings having properties with a strength not less than 3.5 cN/dtex and with an elasticity modulus not less than 30 cN/dtex is prepared. The silk fibroin fibers multi-filament strings are processed into the twisted cord, and thereafter, by applying an adhesive agent formed of a mixture of resorcin, formalin and rubber latex to the cord, the cord is covered with the adhesive agent in order that a solids content of a coverage of the adhesive agent covering the cord can become not less than 4.0% and not more than 8.0% per unit weight of the fibers. Thereafter, the cord is dried at a temperature between 90 and 130° C. inclusive, and then is thermally treated at a temperature between 140 and 200° C. inclusive.

More preferably, as the adhesive agent formed of the mixture of resorcin, formalin and rubber latex, it is preferable to use the adhesive agent having the F/R molar ratio between 2.0 and 3.5 inclusive, and the RF/L solids content ratio, which is a ratio of the solids content RF of resorcin and formalin to the solids content L of rubber latex, set in a range from 0.20 to 0.35 inclusive. Additionally, it is preferable to apply the adhesive agent to the cord in order that a solids content of a dip pickup of the adhesive agent covering the cord can become not less than 4.0% and not more than 8.0% per unit weight of the fibers, then perform a drying treatment on the cord at a temperature between 90 and 130° C. inclusive for 1 to 3 minutes, and further, perform thereafter a thermal treatment on the cord at a temperature between 140 and 200° C. inclusive for 1 to 2 minutes, or more preferably, at a temperature between 150 and 180° C. inclusive for 1 to 2 minutes.

By setting the temperature to 140° C. or above during the thermal treatment performed after the application and the desiccation of the RFL liquid mixture, it becomes possible to secure adhesion of the rubber reinforcing fiber cord to rubber. Meanwhile, if the temperature exceeds 200° C., it causes the cord to be not only reduced in strength, but also reduced in high-heat strength retention rate. Therefore, the cord thermally treated at a temperature exceeding 200° C. is not appropriate for rubber reinforcement use.

Additionally, if the temperature during the drying treatment is less than 90° C., desiccation becomes insufficient, and it leads to insufficient adhesion of the cord afterward even after the cord has gone through the thermal treatment. Furthermore, if the temperature exceeds 130° C., the RFL liquid mixture generates foam, and thereby, there is a problem that adhesion thereof is reduced.

With regard to tensions provided to the cord during the drying treatment and during the thermal treatment, it is preferable that the tensions be set in ranges between 0.15 and 0.40 cN/dtex inclusive during the drying treatment and between 0.20 and 0.60 cN/dtex inclusive during the thermal treatment. It is more preferable that the tension during the thermal treatment be set higher than the tension during the drying treatment. If the tension during the drying treatment is lower than 0.15 cN/dtex, the cord becomes insufficient in elasticity modulus as a cord for reinforcement use in a rubber product comparable to an automobile tire. If that is higher than 0.40 cN/dtex, it brings about a considerable reduction in elongation of the cord, and also a reduction in adhesion thereof.

Additionally, when the tension during the thermal treatment is lower than 0.20 cN/dtex, it brings about a reduction in elasticity modulus after the thermal treatment. If that is higher than 0.60 cN/dtex, there is a problem that it brings about reductions in elongation and adhesion of the cord.

As has been stated hereinabove, it is preferable to additionally compound an isocyanate derivative in the RFL liquid mixture. By compounding the isocyanate derivative therein, water resistant adhesion of the reinforcing cord to rubber can be enhanced.

While the rubber reinforcing fiber cord of the present invention can be used in rubber products in general, the cord is particularly effective, and can more conspicuously exert effects thereof when it is used as a reinforcing cord of a radial pneumatic tire. Particularly in a radial pneumatic tire for a passenger car, it is favorable if the cord is used as at least any one of a reinforcing cord of a belt reinforcing layer arranged in at least one region out of regions to an outer periphery of the belt layers, to an inner periphery thereof, and between the outer and inner belt layers, and a carcass cord of a carcass layer.

FIG. 1 shows a radial pneumatic tire for a passenger car using a rubber reinforcing fiber cord of the present invention by taking a half cross-sectional view of a right half divided by a central equator of the tire.

The radial pneumatic tire is constituted in a fashion that sidewall portions 2, 2 and bead portions 3, 3 are connected to right and left sides of a tread 1. In an inward portion of the tire, a carcass layer 4 is provided, and both end portions thereof around bead cores 5, 5 are folded back from an inside to an outside of the tire. To an outer periphery of the carcass layer 4, two belt layers 6 formed of steel cords are arranged in a manner that steel cords of one belt layer are crossed with respect to those of the other belt layer. To an outer periphery of the two belt layers 6, a belt reinforcing layer 7 is provided.

Here, more than one of the carcass layers 4 may be provided, three belt layers 6 may be provided, and as cords used in the belt layers 6, fiber cords, such as aramid fibers, which has a high elasticity modulus may be used in addition to steel cords.

The belt reinforcing layer 7 is composed of a full-cover layer 7*a* covering an entire width of the belt layers 6, and edge cover layers 7*b* covering only left and right edge portions thereof. The belt reinforcing layer 7 may have a configuration provided only with the full-cover layer 7*a* or the edge cover layers 7*b*, and additionally, may have a configuration having more than one of the full-cover layer 7*a*.

The belt reinforcing layer 7 is not limited to being provided only to the outer periphery of the belt layers, and can also be arranged between the belt layers, or to an inner periphery of the belt layers, that is, between the belt layer and the carcass layer. In each of the above cases, the belt reinforcing layer is formed in a manner that: one or plural ones of the reinforcing cords are pulled together and rubberized to be formed into a tape; and the tape is spirally wrapped at an angle between 0 and 10 degrees inclusive with respect to a circumferential direction of the tire.

A radial pneumatic tire for a passenger car of the present invention uses the above described rubber reinforcing fiber cord as at least any one of a reinforcing cord of a belt reinforcing layer thereof, and a reinforcing cord of a carcass layer thereof. In the case of the radial pneumatic tire in which the rubber reinforcing fiber cord formed of silk fibroin fibers is used for the belt reinforcing layer, the tire can exert, with respect to high-speed durability, a performance equivalent to a radial pneumatic tire in which a conventional nylon fiber cord is used for a belt reinforcing layer. At the same time, with respect to road noise, the tire can exert a more excellent road noise reduction effect than the tire using the conventional nylon fiber cord as a result of having a higher elasticity modulus than that of the tire using the nylon fiber cord.

Additionally, in the case of the radial pneumatic tire in which the rubber reinforcing fiber cord of silk fibroin fibers is used for the carcass layer, the tire can improve driving stability and riding comfort with increased stiffness of the carcass layer.

EXAMPLES 1 TO 3 AND COMPARATIVE EXAMPLES 1 AND 2

By using, as silk fibroin fibers, silk strings (in which, in amino-acid components, a total weight percentage of alanine and glycine is 75.2% and a total weight percentage of aspartic acid and arginine is 2.6%) obtained from domesticated silkworms, there were obtained examples of a cord twisted in two directions having a cord structure of 840 dtex/2, the number of second twists at 20 turns/10 cm, and the number of first twists at 20 turns/10 cm. A strength and an elasticity modulus of the cord were 4.4 cN/dtex and 45 cN/dtex, respectively.

On the other hand, RFL liquid mixtures were obtained by mixing components as described in Table 1, which are soft water, 10% NaOH solution, resorcin, 37% formalin solution, and Nipol 2518FS (manufactured by Zeon Corporation, vinylpyridine-styrene-butadiene terpolymer rubber latex, containing a solids content by 40%). They were mixed in order that compounding ratios of the respective components can allow the respective RFL liquid mixtures to have RFL solids content concentrations of 10 weight %, 20 weight %, 15 weight %, 25 weight %, and 35 weight % as shown in Table 1 (for Examples 1 to 3 and Comparative Examples 1 and 2, respectively).

The RFL liquid mixtures each thus having been adjusted with respect to the RFL solids content ratios thereof were applied to the silk fibroin fiber twisted cords. Then, the cords were dried under an identical condition which is at a temperature of 100° C., at a tension of 0.25 cN/dtex, and with a drying period for 2 minutes, and thereafter, were thermally treated under a condition which is at a thermal treatment temperature of 180° C., at a tension of 0.4 cN/dtex, and with a thermal treatment period for 1 minute and 30 seconds. By performing the above processes on the cords, as described in Table 2, five kinds of rubber reinforcing fiber cord set respectively having dip pickups of the RFL adhesive agent of 3.5%, 5.5%, 4.5%, 7.0% and 8.8% were manufactured.

Results described in Table 2 were obtained with respect to the thus obtained five kinds of rubber reinforcing fiber cord when RFL dip pickups, initial tensile strengths, post-moisture-absorption strength retention rates, high-temperature strength retention rates, peel adhesion strengths, and water resistant adhesion strengths thereof were respectively measured by the above and below described measuring methods.

From the results in Table 2, each of the rubber reinforcing fiber cords of Examples 1 to 3 had the initial tensile strength not less than 4.0 cN/dtex, the high-temperature strength retention rate not less than 82%, and the post-moisture-absorption strength retention rate not less than 88%, and at the same time, had the peel adhesion strength and the water resistant adhesion strength at high levels. With these results, it can be found that, as reinforcing materials for use in rubber products acted upon by large loads, the cords of Examples 1 to 3 are more excellent than the cords of Comparative Examples 1 and 2.

[Peel Adhesion Strength]

For the peel adhesion strength, a two-ply peeling sample by using tire carcass rubber formed of a composition shown in Table 3 was prepared, and a peel force between plies thereof was measured as the peel adhesion strength.

The two-ply sample was prepared in the following manner. First, each of the two plies were prepared. For the each, the treated cords were arranged on one rubber sheet by pulling the cords together in a longitudinal direction of the rubber sheet in order that the cords can be in a closest packing state, the one rubber sheet having a thickness of 2 mm, a width of 25 mm and a length of 250 mm. Thereafter, another rubber sheet having a thickness of 0.4 mm, a width of 25 mm and a length of 250 mm was laid on the cords, whereby one ply as the each was prepared. The two-ply sample was prepared by sticking surfaces of the 0.4 mm thick rubber sheets of these two plies to each other. This two-ply sample was vulcanized for 30 minutes at a temperature of 150° C., thereby being prepared as a peeling sample. In a peeing test, a peel force between the plies thereof was measured.

[Water Resistant Adhesion Strength]

For the water resistant adhesion strength, a two-ply peeling sample was prepared as in the case with the above test. After the two-ply sample was soaked in warm water of 70° C. for a week, a peel force between plies thereof was measured as the water resistant adhesion strength immediately after the two-ply sample was taken out of the warm water.

TABLE 1

| | Comparative Example 1 | Example 1 | Example 2 | Example 3 | Comparative Example 2 |
|---|---|---|---|---|---|
| RFL composition (weight %) | | | | | |
| Soft water | 75.3 | 50.3 | 63.1 | 39.3 | 13.9 |
| 10% NaOH solution | 1.5 | 2.9 | 2.2 | 2.8 | 5.1 |
| Resorcin | 1.4 | 2.7 | 2.0 | 3.4 | 4.7 |
| 37% formalin solution | 2.5 | 5.1 | 3.8 | 6.4 | 8.9 |
| Nipol 2518FS (*) | 19.3 | 38.5 | 28.9 | 48.1 | 67.4 |
| RFL solids content concentration (weight %) | 10 | 20 | 15 | 25 | 35 |

(*) Manufactured by Zeon Corporation vinylpyridine-styrene-butadiene terpolymer rubber latex, containing a solids content by 40%

TABLE 2

| | Comparative Example 1 | Example 1 | Example 2 | Example 3 | Comparative Example 2 |
|---|---|---|---|---|---|
| RFL dip pickup (weight %) | 3.5 | 5.5 | 4.5 | 7.0 | 8.5 |
| Initial strength (cN/dtex) | 4.2 | 4.1 | 4.2 | 4.0 | 3.8 |
| High-temperature strength retention rate (%) | 77 | 85 | 82 | 84 | 79 |
| Post-moisture-absorption strength retention rate (%) | 82 | 90 | 88 | 90 | 87 |
| Peel adhesion strength (N/25 mm) | 140 | 210 | 180 | 220 | 160 |
| Water resistant adhesion strength (N/25 mm) | 25 | 65 | 60 | 65 | 45 |

TABLE 3

| Rubber composition | Weight parts |
|---|---|
| NR | 60 |
| SBR | 40 |
| Zinc oxide | 4 |
| Stearic acid | 1.5 |
| Antioxidant | 1 |
| Carbon black | 60 |
| Oil | 8 |
| Sulfur | 3 |
| Vulcanization accelerator | 1.5 |

EXAMPLES 4 TO 8

There were prepared five kinds of rubber reinforcing fiber cord different from Example 1 in that, in the RFL liquid mixtures, only F/R molar ratios thereof were set differently to 1.5, 2.0, 3.0, 3.5 and 4.0 as described in Table 4 while RFL solids content concentrations thereof were uniformly set equal to 20% of Example 1. Other than the above difference, they were prepared through the covering treatments under the same condition as that of Example 1 (to be Examples 4 to 8).

Results obtained through the same physical property measurement as described in Table 2 with respect to these respective rubber reinforcing fiber cords are shown in Table 5.

From Table 5, it can be found that, when the F/R molar ratio of the RFL adhesive agent is less than 2.0, the post-moisture-absorption strength retention rate and the high-temperature strength retention rate decrease. On the other hand, it can be found that, when the F/R molar ratio exceeds 3.5, the initial tensile strength, the high-temperature strength retention rate, and the peel adhesion strength decrease as compared to the other examples. With these results, it can be found that it is more preferable to have the F/R molar ratio in a range between 2.0 and 3.5 inclusive.

TABLE 4

| | Example 4 | Example 5 | Example 6 | Example 7 | Example 8 |
|---|---|---|---|---|---|
| RFL composition (weight %) | | | | | |
| Soft water | 51.0 | 50.8 | 50.8 | 50.7 | 50.5 |
| 10% NaOH solution | 3.6 | 3.3 | 2.7 | 2.5 | 2.4 |
| Resorcin | 3.3 | 3.0 | 2.5 | 2.3 | 2.2 |
| 37% formalin solution | 3.6 | 4.4 | 5.5 | 6.0 | 6.4 |
| Nipol 2518FS | 38.5 | 38.5 | 38.5 | 38.5 | 38.5 |
| RFL solids content concentration (weight %) | 20 | 20 | 20 | 20 | 20 |
| F/R molar ratio | 1.5 | 2.0 | 3.0 | 3.5 | 4.0 |

TABLE 5

| | Example 4 | Example 5 | Example 6 | Example 7 | Example 8 |
|---|---|---|---|---|---|
| RFL dip pickup (weight %) | 5.5 | 5.4 | 5.5 | 5.6 | 5.5 |
| Initial strength (cN/dtex) | 4.2 | 4.2 | 4.1 | 4.1 | 3.9 |
| High-temperature strength retention rate (%) | 86 | 85 | 85 | 84 | 83 |
| Post-moisture-absorption strength retention rate (%) | 86 | 89 | 92 | 92 | 92 |
| Peel adhesion strength (N/25 mm) | 185 | 200 | 210 | 190 | 160 |
| Water resistant adhesion strength (N/25 mm) | 40 | 60 | 70 | 65 | 45 |

EXAMPLES 9 TO 13

There were prepared five kinds of rubber reinforcing fiber cord different from Example 1 in that, in the RFL liquid mixtures, only RF/L solids content weight ratios thereof were set differently to 0.15, 0.2, 0.25, 0.35 and 0.4 as described in Table 6 while RFL solids content concentrations and F/R molar ratios thereof were uniformly set equal respectively to 20% and 2.5 as in Example 1. Other than the above difference, they were prepared through the covering treatments under the same condition as Example 1 (to be Examples 9 to 13).

Results obtained through the same physical property measurement as described in Table 2 with respect to these respective rubber reinforcing fiber cords are shown in Table 7.

From Table 7, it can be found that, when the RF/L solids content weight ratio of the RFL adhesive agent is less than 0.2, the post-moisture-absorption strength retention rate and the high-temperature strength retention rate, and the water resistant adhesion strength decrease. On the other hand, it can be found that, when the RF/L solids content weight ratio exceeds 0.35, the initial strength and the peel adhesion strength decrease as compared to the other examples. With these results, it can be found that it is more preferable to have the RF/L solids content weight ratio in a range between 0.20 and 0.35 inclusive.

TABLE 6

| | Example 9 | Example 10 | Example 11 | Example 12 | Example 13 |
|---|---|---|---|---|---|
| RFL composition (weight %) | | | | | |
| Soft water | 50.5 | 50.5 | 50.8 | 51.2 | 51.2 |
| 10% NaOH solution | 1.6 | 2.1 | 2.5 | 3.1 | 3.5 |
| Resorcin | 1.5 | 2.0 | 2.3 | 3.0 | 3.3 |
| 37% formalin solution | 2.9 | 3.7 | 4.4 | 5.7 | 6.3 |
| Nipol 2518FS | 43.5 | 41.7 | 40.0 | 37.0 | 35.7 |
| RFL solids content concentration (weight %) | 20 | 20 | 20 | 20 | 20 |
| F/R molar ratio | 2.5 | 2.5 | 2.5 | 2.5 | 2.5 |
| RF/L solids content weight ratio | 0.15 | 0.2 | 0.25 | 0.35 | 0.4 |

TABLE 7

| | Example 9 | Example 10 | Example 11 | Example 12 | Example 13 |
|---|---|---|---|---|---|
| RFL dip pickup (weight %) | 5.4 | 5.5 | 5.5 | 5.6 | 5.4 |
| Initial strength (cN/dtex) | 4.2 | 4.2 | 4.2 | 4.0 | 3.8 |
| High-temperature strength retention rate (%) | 81 | 82 | 84 | 85 | 86 |
| Post-moisture-absorption strength retention rate (%) | 85 | 87 | 90 | 91 | 91 |
| Peel adhesion strength (N/25 mm) | 190 | 200 | 210 | 190 | 165 |
| Water resistant adhesion strength (N/25 mm) | 45 | 60 | 65 | 70 | 60 |

EXAMPLES 14 TO 16

There were prepared another three kinds of rubber reinforcing fiber cord different from Example 1 only in that, in the RFL liquid mixtures, a blocked isocyanate 40% water dispersion obtained by blocking an isocyanate terminal of methyl diisocyanate (MDI) by use of methyl ethyl keto oxime is added as an isocyanate derivative in order that solids contents of the blocked isocyanate can be 15 weight parts, 30 weight parts, and 50 weight parts, respectively, with respect to 100 weight parts of the RFL solids contents thereof. Other than the above difference, they were prepared through the covering treatments under the same condition as Example 1.

Results obtained through the same physical property measurement as described in Table 2 with respect to these respective rubber reinforcing fiber cords are shown in Table 9.

From Table 9, it can be found that the compounding of the isocyanate derivative in the adhesive agent leads to remarkable enhancement in water resistant adhesion. Additionally, as a compounding amount thereof, it can be found that a range between 10 and 30 weight parts inclusive with respect to 100 weight parts of the RFL solids contents is more preferable. In a case when the compounding amount exceeds 30 weight parts, a degree of enhancement in water resistant adhesion is saturated, and at the same time, the initial strength tends to decrease because the cord becomes harder.

TABLE 8

| | Example 14 | Example 15 | Example 16 |
|---|---|---|---|
| RFL composition (weight %) | | | |
| Soft water | 50.8 | 50.7 | 50.6 |
| 10% NaOH solution | 2.5 | 2.2 | 1.9 |
| Resorcin | 2.3 | 2.1 | 1.8 |
| 37% formalin solution | 4.4 | 3.9 | 3.4 |
| Nipol 2518FS | 33.5 | 29.6 | 25.6 |
| blocked isocyanate 40% water diffused solution | 6.5 | 11.5 | 16.7 |
| RFL solids content concentration (weight %) | 20 | 20 | 20 |
| Ratio of blocked isocyanate to solids content | 0.15 | 0.3 | 0.5 |
| F/R molar ratio | 2.5 | 2.5 | 2.5 |

TABLE 8-continued

| | Example 14 | Example 15 | Example 16 |
|---|---|---|---|
| RF/L solids content weight ratio | 0.3 | 0.3 | 0.3 |

TABLE 9

| | Example 14 | Example 15 | Example 16 |
|---|---|---|---|
| RFL dip pickup (weight %) | 5.5 | 5.6 | 5.7 |
| Initial strength (cN/dtex) | 4.1 | 4.0 | 3.8 |
| High-temperature strength retention rate (%) | 85 | 86 | 86 |
| Post-moisture-absorption strength retention rate (%) | 91 | 92 | 92 |
| Peel adhesion strength (N/25 mm) | 235 | 240 | 240 |
| Water resistant adhesion strength (N/25 mm) | 170 | 185 | 170 |

EXAMPLES 17 AND 18 AND COMPARATIVE EXAMPLE 3

There were prepared three kinds of rubber reinforcing fiber cord A, B and C respectively formed of the below described configurations. By using these cords, three kinds of radial pneumatic tires for passenger cars having a tire size of 225/45R17 were fabricated. The tires were configured to use these respective kinds of cord as belt reinforcing layers thereof in each of which the number of placing of the cord was set to 60 lines/5 cm.

(1) Rubber Reinforcing Fiber Cord A

The same rubber reinforcing fiber cord as the one fabricated as Example 1 (Example 17).

(2) Rubber Reinforcing Fiber Cord B

A rubber reinforcing fiber cord obtained in the following manner. By using, as silk fibroin fibers, silk strings (in which a total content of alanine and glycine is 72.2% and a total content of aspartic acid and arginine is 13.9%) obtained from wild silkworms (Sakusan), a two-direction twisted cord having a cord structure of 840 dtex/2, the number of second twists at 20 turns/10 cm, and the number of first twists at 20 turns/10 cm as in the case with Example 1 was obtained. A strength and an elasticity modulus of the cord were 4.2 cN/dtex and 39 cN/dtex, respectively. On this twisted cord, by using the same RFL mixed solution as in the case with Example 1, the same adhesive agent treatment and the same drying and thermal treatment conditions as in that case were applied to obtain the rubber reinforcing fiber cord (Example 18).

(3) Rubber Reinforcing Fiber Cord C

A rubber reinforcing fiber cord obtained in the following manner. Multiple filaments formed of 66 nylon fibers and having a nominal fineness of 940 dtex were processed into a twisted cord having a cord structure of 940 dtex/2, the number of second twists at 19 turns/10 cm, and the number of first twists at 19 turns/10 cm. A strength and an elasticity modulus of the cord were 8.7 cN/dtex and 22 cN/dtex, respectively. An RFL mixed solution having a composition shown in Table 1 was applied on this twisted cord, and then, the cord was dried for 2 minutes at a temperature of 130° C. and at a tension of 0.25 cN/dtex, and thereafter, was thermally treated for 1 minute and 30 seconds at a temperature of 220° C. and at a tension of 0.75 cN/dtex to obtain the rubber reinforcing fiber cord (Comparative Example 3).

Results obtained by measuring RFL dip pickups, initial tensile strengths, elasticity moduli, post-moisture-absorption strength retention rates, high-temperature strength retention rates, peel adhesion strengths, and water resistant adhesion strengths as in the case with Table 2 with respect to these respective three kinds of rubber reinforcing fiber cord are shown in Table 11.

Additionally, results obtained by measuring high-speed durability and road noise with respect to the above there kinds of radial pneumatic tires are also shown in Table 11.

From the results shown in Table 11, it can be found that the tires of Examples 17 and 18 according to the present invention had high-speed durability at least equivalent to high-speed durability of Comparative Example 3, and furthermore, are more excellent in road noise reduction effect than Comparative Example 3. Additionally, by comparing Examples 17 and 18 with each other, it can be found that the domesticated silkworms having a lower total content of aspartic acid and arginine than the wild silkworms provide more excellent performances in tire characteristics than the wild silkworms.

[High-Speed Durability]

Each of the test tires was rim-assembled to a rim having a rim size of 7.5 JJ-17 while being inflated with a pneumatic pressure of 220 kPa. Then, the tire was tested by using a drum testing machine having a diameter of 1707 mm and under a condition that the tire was loaded with 88% of a maximum load defined by JATMA, was continuously driven for 2 hours at a speed of 81 km/h, and after cooling was given thereto, was restarted to be driven at a speed of 121 km/h with a stepwise speed increase of 8 km/h every 30 minutes. In the test, a mileage until a failure occurred in the tire was measured.

Assessment for high-speed durability was expressed in index number obtained by setting a measured value for Comparative Example 3 as 100. The higher this index number is, the more excellent high-speed durability is.

[Road Noise]

Each of the test tires was installed onto an actual automobile in which a sound collecting microphone was set on a window of a driver's seat, and road noise was collected through the sound collecting microphone when the automobile was driven on a rough road surface at a speed of 50 km/h. Frequencies of the thus collected road noise were analyzed, and a comparison was made with respect to noise levels of the tires at 315 Hz. Assessment for road noise was expressed in difference (dB) from a measured value for Comparative Example 3. If the tire has a value for the assessment which is negative and higher in absolute value, it means that the tire has a more excellent road noise reduction effect.

TABLE 10

| RFL composition (weight %) | |
|---|---|
| Soft water | 75 |
| 10% NaOH solution | 1.1 |
| Resorcin | 1.0 |
| 37% formalin solution | 1.1 |
| Nipol 2518FS | 21.8 |
| RFL solids content concentration (weight %) | 10 |
| F/R molar ratio | 1.5 |
| RF/L solids content weight ratio | 0.15 |

TABLE 11

| | Comparative Example 3 | Example 17 | Example 18 |
|---|---|---|---|
| RFL dip pickup (weight %) | 3.8 | 5.5 | 5.6 |
| Initial strength (cN/dtex) | 8.5 | 4.1 | 3.9 |
| Tensile elasticity modulus (cN/dtex) | 24 | 80 | 54 |

TABLE 11-continued

| | Comparative Example 3 | Example 17 | Example 18 |
|---|---|---|---|
| High-temperature strength retention rate (%) | 91 | 85 | 83 |
| Post-moisture-absorption strength retention rate (%) | 97 | 90 | 88 |
| Peel adhesion strength (N/25 mm) | 230 | 210 | 200 |
| Water resistant adhesion strength (N/25 mm) | 150 | 65 | 60 |
| Tire characteristics: | | | |
| High-speed durability (index number) | 100 | 103 | 100 |
| 315 Hz road noise (dB) | 0 | −1.5 | −0.8 |

EXAMPLES 19 AND 20 AND COMPARATIVE EXAMPLE 4

There were prepared three kinds of rubber reinforcing fiber cord D, E and F respectively formed of the below described configurations. By using these cords, three kinds of radial pneumatic tires for passenger cars having a tire size of 225/45R17 were fabricated. The tires were configured to use theses respective kinds of cord as the carcass layers thereof in each of which the number of placing of the cord was set to 45 lines/5 cm. Each of the tires includes two plies of this carcass layer.

(1) Rubber Reinforcing Fiber Cord D

A rubber reinforcing fiber cord is obtained in the following manner. By using, as silk fibroin fibers, silk strings (in which a total content of alanine and glycine is 75.2% and a total content of aspartic acid and arginine is 2.6%) obtained from domesticated silkworms, the silk fibroin fibers were processed into a twisted cord having a cord structure of 1690 dtex/2, the number of second twists at 40 turns/10 cm, and the number of first twists at 40 turns/10 cm. A strength and an elasticity modulus of the cord were 4.0 cN/dtex and 38 cN/dtex, respectively. On this twisted cord, by using the same RFL mixed solution as in the case with Example 1, the same adhesive agent treatment as in that case was applied to obtain the rubber reinforcing fiber cord (Example 19).

(2) Rubber Reinforcing Fiber Cord E

A rubber reinforcing fiber cord is obtained in the following manner. By using, as silk fibroin fibers, silk strings (in which a total content of alanine and glycine is 72.2% and a total content of aspartic acid and arginine is 13.9%) obtained from wild silkworms (Sakusan), the silk fibroin fibers were processed into a twisted cord having a cord structure of 1690 dtex/2, the number of second twists at 40 turns/10 cm, and the number of first twists at 40 turns/10 cm as in the case with Example 1 was obtained. A strength and an elasticity modulus of the cord were 3.9 cN/dtex and 35 cN/dtex, respectively. On this twisted cord, by using the same RFL mixed solution as in the case with Example 1, the same adhesive agent treatment as in that case were performed to obtain the rubber reinforcing fiber cord (Example 20).

(3) Rubber Reinforcing Fiber Cord F

A rubber reinforcing fiber cord is obtained in the following manner. Multiple filaments formed of polyester fibers and having a nominal fineness of 1100 dtex were processed into a twisted cord having a cord structure of 1100 dtex/2, the number of second twists at 50 turns/10 cm, and the number of first twists at 50 turns/10 cm. A strength and an elasticity modulus of the cord were 6.8 cN/dtex and 29 cN/dtex, respectively. An RFL mixed solution having a composition shown in Table 12 was applied on this twisted cord, and then, the cord was dried for 2 minutes at a temperature of 130° C. and at a tension of 0.10 cN/dtex, and thereafter, was thermally treated for 1 minute and 30 seconds at a temperature of 240° C. and at a tension of 0.25 cN/dtex to obtain the rubber reinforcing fiber cord (Comparative Example 4).

Results obtained by measuring RFL coverages, initial strengths, elasticity moduli, post-moisture-absorption strength retention rates, high-temperature strength retention rates, peel adhesion strengths, and water resistant adhesion strengths as in the case with Table 2 with respect to these respective three kinds of rubber reinforcing fiber cord are shown in Table 13.

Additionally, results obtained by measuring driving stability and riding comfort with respect to the above three kinds of radial pneumatic tire are also shown in Table 13.

From the results shown in Table 13, it can be found that the tires of Examples 19 and 20 according to the present invention had both driving stability and riding comfort at least substantially equivalent to those of Comparative Example 4.

[Driving Stability]

Each of the tires was scored with respect to driving stability by use of a 5-point scale method in feeling tests performed by 5 professional test drivers, and was assessed by taking an average of scores given to the tire by the 5 drivers. Those averages were compared by setting the average for Comparative Example 4 as 3.0.

[Riding Comfort]

Each of the tires was scored with respect to riding comfort in the same feeling tests as was performed for the above driving stability assessment. Averages of scores given to the respective tires were compared by setting the average for Comparative Example 4 as 3.0.

TABLE 12

| RFL composition (weight %): | |
|---|---|
| Soft water | 62.5 |
| 10% NaOH solution | 1.0 |
| Resorcin | 0.9 |
| 37% formalin solution | 1.0 |
| Nipol 2518FS | 19.6 |
| Denabond(**) | 15.0 |
| RFL solids content concentration (weight %) | 15 |
| F/R molar ratio | 1.5 |
| RF/L solids content weight ratio | 0.15 |

(**) Manufactured by Nagase ChemteX Corporation, an ammonium solution of a chlorophenol-formaldehyde-resorcinol condensate containing a solid content by 40%

TABLE 13

| | Comparative Example 4 | Example 19 | Example 20 |
|---|---|---|---|
| RFL dip pickup (weight %) | 4.2 | 5.5 | 5.6 |
| Initial strength (cN/dtex) | 6.6 | 3.8 | 3.7 |
| Tensile elasticity modulus (cN/dtex) | 43 | 60 | 45 |
| High-temperature strength retention rate (%) | 97 | 85 | 83 |
| Post-moisture-absorption strength retention rate (%) | 99 | 90 | 88 |
| Peel adhesion strength (N/25 mm) | 225 | 195 | 190 |
| Water resistant adhesion strength (N/25 mm) | 125 | 70 | 65 |

TABLE 13-continued

| | Comparative Example 4 | Example 19 | Example 20 |
|---|---|---|---|
| Tire characteristics: | | | |
| Driving stability | 3.0 | 3.4 | 3.2 |
| Riding comfort | 3.0 | 3.1 | 3.1 |

What is claimed is:

1. A rubber reinforcing fiber cord comprising: a multi-filament twisted cord formed of silk fibroin fibers having a total fineness between 1500 and 9000 dtex inclusive is covered with an adhesive agent formed of a mixture of resorcin, formalin and rubber latex; a dip pickup of the adhesive agent covering the multi-filament twisted cord is not less than 4.0% and not more than 8.0% per unit weight of the fibers; and the covered twisted cord has an initial tensile strength not less than 3.5 cN/dtex, a high-temperature strength retention rate not less than 80%, and a post-moisture-absorption strength retention rate not less than 85%.

2. The rubber reinforcing fiber cord according to claim 1 wherein a tensile elasticity modulus of the covered twisted cord not less than 40 cN/dtex.

3. The rubber reinforcing fiber cord according to claim 1 wherein a molar ratio of formalin to resorcin of the adhesive agent is in a range from 2.0 to 3.5 inclusive.

4. The rubber reinforcing fiber cord according to claim 1 wherein a ratio of a solids content weight of rubber latex to a total solids content weight of formalin and resorcin of the adhesive agent is in a range from 0.20 to 0.35 inclusive.

5. The rubber reinforcing fiber cord according to claim 1 wherein the silk fibroin fibers contain alanine and glycine whose total content in amino-acid components thereof is not less than 60%.

6. The rubber reinforcing fiber cord according to claim 1 wherein the silk fibroin fibers contain aspartic acid and arginine whose total content in amino-acid components thereof is not more than 5%.

7. The rubber reinforcing fiber cord according to claim 1 wherein an isocyanate derivative is compounded in the adhesive agent.

8. The rubber reinforcing fiber cord according to claim 7 wherein a compounding amount of the isocyanate derivative is in a range from 5 to 50 weight parts inclusive with respect to 100 weight parts of a solids content of resorcin, formalin and rubber latex.

9. A method of manufacturing the rubber reinforcing fiber cord according to claim 1, comprising the steps of:

applying a liquid mixture of resorcin, formalin and rubber latex to a multi-filament twisted cord formed of silk fibroin fibers having a total fineness of 1500 to 9000 dtex;

thereafter, drying the twisted cord at a temperature between 90 and 130° C. inclusive; and thereafter, thermally treating the twisted cord at a temperature between 140 and 200° C. inclusive.

10. A radial pneumatic tire for a passenger car including a carcass layer, belt layers, and a belt reinforcing layer which is formed by winding a reinforcing cord around in a circumferential direction of the tire, wherein the rubber reinforcing fiber cord according to claim 1 is used as the reinforcing cord of the belt reinforcing layer, the carcass layer being arranged between left and right bead portions of the tire, the belt layers being arranged to an outer periphery of the carcass layer, and the belt reinforcing layer being arranged in at least one region out of regions to an outer periphery of the belt layers, to an inner periphery thereof, and between the outer and inner belt layers.

11. A radial pneumatic tire for a passenger car including a carcass layer arranged between left and right bead portions of the tire, wherein the rubber reinforcing fiber cord according to claim 1 is used as a reinforcing cord of the carcass layer.

* * * * *